US012796765B2

(12) United States Patent
Storey et al.

(10) Patent No.: US 12,796,765 B2
(45) Date of Patent: Nov. 17, 2026

(54) HELMET

(71) Applicant: GEORGE TFE SCP, Monaco (MC)

(72) Inventors: Piers Christian Storey, Monaco (MC); John George Lloyd, Monaco (MC)

(73) Assignee: GEORGE TFE SCP, Monaco (MC)

( * ) Notice: Subject to any disclaimer, the term of this patent is extended or adjusted under 35 U.S.C. 154(b) by 0 days.

(21) Appl. No.: 19/154,546

(22) PCT Filed: Mar. 10, 2023

(86) PCT No.: PCT/IB2023/052320
§ 371 (c)(1),
(2) Date: Aug. 7, 2025

(87) PCT Pub. No.: WO2024/189392
PCT Pub. Date: Sep. 19, 2024

(65) Prior Publication Data
US 2026/0108006 A1 Apr. 23, 2026

(51) Int. Cl.
*A42B 3/12* (2006.01)
*A42B 3/06* (2006.01)

(52) U.S. Cl.
CPC . *A42B 3/12* (2013.01); *A42B 3/06* (2013.01)

(58) Field of Classification Search
CPC ..... A42B 3/12; A42B 3/306
USPC ..... 2/411
See application file for complete search history.

(56) References Cited

U.S. PATENT DOCUMENTS

| | | | | |
|---|---|---|---|---|
| 6,282,724 | B1 * | 9/2001 | Abraham | A41D 13/015 2/455 |
| 7,802,320 | B2 * | 9/2010 | Morgan | A42B 3/124 2/412 |
| 10,736,373 | B2 | 8/2020 | Chilson et al. | |
| 10,834,987 | B1 * | 11/2020 | Bottlang | A42B 3/125 |
| 11,944,149 | B2 * | 4/2024 | Halldin | A42B 3/064 |
| 12,439,989 | B2 * | 10/2025 | Von Dunten | A42B 3/14 |
| 2004/0250340 | A1 * | 12/2004 | Piper | A42B 3/064 2/412 |
| 2007/0190292 | A1 * | 8/2007 | Ferrara | A42B 3/121 428/166 |
| 2015/0047110 | A1 | 2/2015 | Chilson | |
| 2019/0231018 | A1 * | 8/2019 | Boutin | A42B 3/124 |
| 2023/0010873 | A1 | 1/2023 | Storey | |

FOREIGN PATENT DOCUMENTS

EP 3473122 A1 4/2019

* cited by examiner

*Primary Examiner* — Gloria M Hale
(74) *Attorney, Agent, or Firm* — Jason Lee DeFrancesco

(57) ABSTRACT

Helmet comprising: at least a cellular energy-absorbing insert; a foam liner comprising at least one recess shaped to accommodate the at least one cellular energy-absorbing insert; a cover layer arranged between the foam liner and the at least one cellular energy-absorbing insert; wherein the cover layer is attached to the at least one cellular energy-absorbing insert so that the cellular energy-absorbing insert slides together with the cover layer over the foam liner in response to an oblique impact.

15 Claims, 5 Drawing Sheets

HELMET

TECHNICAL FIELD

The present invention relates to the field of helmets with cellular energy-absorbing structures. In particular, the present invention relates to helmets using layered structures.

BACKGROUND ART

In the state of the art some helmet solutions using cellular energy-absorbing structures are known. These kinds of structures have excellent properties in terms of impact energy absorption with respect to traditional polymeric foam materials. Despite this, the foam allows to obtain fascinating shapes and is still easier to mold with respect to the cellular structures. Therefore, many solutions employing these kinds of energy-absorbing structures combine the use of foam liners and cellular structures.

An example in this sense is disclosed in the patent U.S. Pat. No. 10,834,987. This document relates to a helmet comprising a plurality of cellular liners that are retained within respective recesses of a polymer foam shell without the necessity of using additional fasteners or adhesive. Substantially, the cellular liner of this document is sized to fit snug within the recess. Despite the cellular liner being retained in the foam shell, during an oblique impact to the helmet, the cellular liner tends to slide over a barrier layer attached to the polymer shell and simultaneously it in-plane compresses. If the impact is serious, the thin edges of the cellular liner facing the foam liner and the barrier layer tend to scratch over the barrier layer creating a friction that strongly reduces the attitude of the cellular liner to slide over the barrier layer, thus increasing the risk of a brain torque in the wearer. This defect becomes even more evident if the cellular liner lies below or behind an air vent of the foam liner. During an impact the cellular liner tends to slide over the barrier layer but when the edges of the cellular liner cross the vents, they get stuck into the vent and the sliding is abruptly interrupted, with serious implications in term of safety.

The patent EP3473122B1 partially solves this problem through vent openings that are chamfered to allow an energy absorbing insert in a cycling helmet to not stop in a vent opening and to slide with a limited restriction.

In addition, the patent U.S. Pat. No. 10,736,373B2 relates to a helmet solution wherein a foam liner is shaped so as to retain one or more cellular inserts inside the foam liner. The foam liner of this helmet comprises vents that allow air to reach the cellular liner and to cross it up to the cavity wherein the head of the wearer is arranged. If the helmet is a ski helmet, the ambient air that enters in the helmet is too cold and the temperature of the head rapidly decreases. In order to avoid this inconvenience, it's known to apply shutters that open and close the vents, but this solution is uneconomic and risky, because the shutter can be an item that reaches the head during an impact or, at best, a potential breaking point of the helmet during an impact. The alternative solution can be that of reducing the section of vents, but this solution creates problems during molding because the inserts of the mold used for realizing these small vents become too thin and they risk to break during opening of mold for extracting the molded foam liner.

SUMMARY

Said and other drawbacks of the state of the art are now solved by a helmet comprising at least a cellular energy-absorbing insert, a foam liner comprising at least one recess shaped to accommodate the at least one cellular energy-absorbing insert, and a cover layer arranged between the foam liner and the at least one cellular energy-absorbing insert. The cover layer is attached to the at least one cellular energy-absorbing insert so that the cellular energy-absorbing insert slides together with the cover layer over the foam liner in response to an oblique impact. The cover layer makes the cellular energy-absorbing insert smoother, less abrasive and rough. In this manner, the cellular energy-absorbing insert slides over the foam liner without jamming. Moreover, the cover layer allows the cellular energy-absorbing insert to slide over the foam liner despite the presence of vents.

Preferably, the cover layer can be made of an elastic material. In this way, the cover layer easily adapts to any in-plane compression of the cellular energy-absorbing insert.

Advantageously, the cover layer can be made of a fabric. In this manner, the cover layer allows a transit of air through the cover layer and easily adapts to any modification of the shape of the cellular energy-absorbing insert, in particular if it is elastic.

The cover layer can be permeable to air. In this way, the air can transit across the cover layer in a limited manner with respect to a cellular energy-absorbing insert devoid of cover layer. This feature makes a ski helmet warmer and more comfortable.

Preferably, the cover layer can be opaque. In this manner, the cellular energy-absorbing insert is not visible from outside through the vents. Moreover, an opaque cover layer allows to personalize the external aspect of the cellular energy-absorbing insert with specific colors or graphics.

In particular, if the helmet comprises an outer shell, the cover layer and the outer shell can have the same color. In this way, the cellular energy-absorbing insert is not visible and it remains camouflaged with the outer shell of the helmet.

Advantageously, the cellular energy-absorbing insert can comprise a plurality of interconnected open cells configured to absorb energy by plastic deformation in response to a longitudinal compressive load applied to said cells. This kind of cellular material provides excellent results in terms of energy-absorption and is very light weight.

In particular, each cell can comprise a tube having a sidewall and a longitudinal axis, and the cells are connected to each other through their sidewalls. This feature enables the production of a sheet of interconnected side-by-side cells.

Preferably, the cover layer can be attached to open ends of said open cells. This attachment between cells and cover layer guarantees the maximum flexibility in terms of deformation to the cellular insert, because the cover layer does not constrict the cellular energy-absorbing insert.

Advantageously, the helmet can comprise a protective layer attached to the foam liner in correspondence of the bottom of said recess. The protecting layer contributes to facilitate the relative sliding of cellular energy-absorbing insert over the foam liner and to prevent the cellular energy-absorbing insert to sink in the foam liner. The protective layer can emphasize the effects of the cover layer.

In particular, the protective layer can be also attached to the sidewall of said recess. In this manner even the insertion or extraction of the cellular energy-absorbing insert, during assembly or disassembly, is facilitated.

Preferably, the protective layer can be a coating or a film layered over the recess of the foam liner. In this manner, the coating can be sprayed over the inner surface of the recess.

Alternatively, the film can be easily attached, for example with an adhesive, to the bottom of the recess.

Advantageously, the cellular energy-absorbing insert can have synclastic properties. This feature makes the cellular energy-absorbing insert spherically deformable without distortion of cells. In this way, the cellular energy-absorbing insert can be realized as a flat sheet that is subsequently curved and inserted in the recess.

Preferably, the cellular energy-absorbing insert can be configured to provide an improved shock absorbing protection as compared with the foam liner. The cellular energy-absorbing insert has higher performance in term of energy absorption than the foam liner. Moreover, being independent from the foam liner, the cellular energy-absorbing insert can be arranged in specific areas of the helmet for improving the protection of certain parts of the wearer's head.

In particular, the foam liner can be made of a polymeric expanded foam. This material makes the foam liner easy to be manufactured and molded.

The foam liner can comprise vents through which the air can transit. The vents allow the transit of air from outside to inside the helmet, up to the cavity in which the head of the wearer lies.

These and other advantages will be better understood thanks to the following description of different embodiments of said invention given as non-limitative examples thereof, making reference to the annexed drawings.

DRAWINGS DESCRIPTION

DETAILED DESCRIPTION

Figure 1:
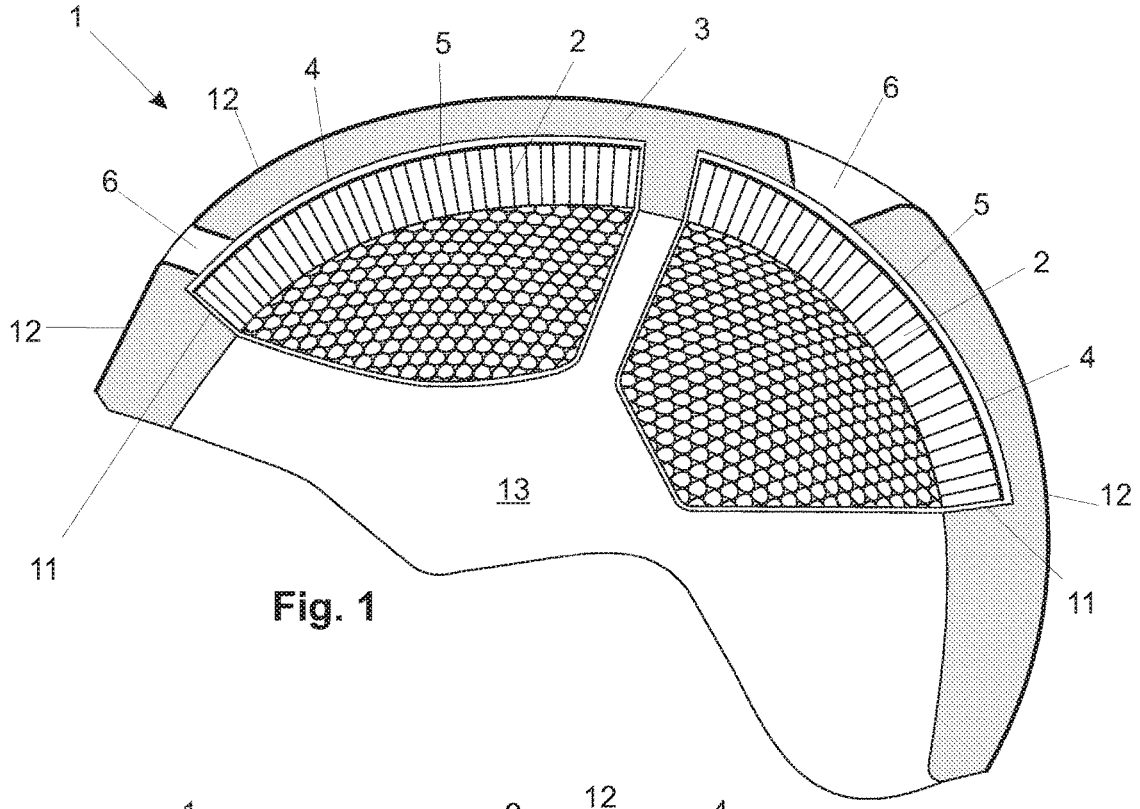
FIG. 1 shows a schematic cross-sectional view of a helmet according to a first embodiment of the present invention.

The following description of one or more embodiments of the invention refers to the annexed drawings. The same reference numbers indicate equal or similar parts. The object of the protection is defined by the annexed claims. Technical details, structures or characteristics of the solutions herebelow described can be combined with each other in any suitable way.

In the following the term "cellular energy-absorbing insert" can be abbreviated with the term "cellular insert".

With the reference number 1 is represented a helmet according to the present invention.

The helmet 1 comprises an outer foam liner 3, preferably made of a polymeric expanded foam like EPS or EPP. The helmet 1 also comprises one or more cellular inserts 2 arranged in respective recesses 4 of the foam liner 2. In the first embodiment, depicted in FIG. 1, the helmet 1 comprises more cellular inserts 2, while in the second embodiment, depicted in FIG. 2, the helmet 1 comprises one cellular insert 2.

Terms "outer" and "inner" refer to an ideal direction that goes from the cavity 13 of the helmet 1 wherein the head of the wearer can be positioned to the outside of the helmet 1.

Each recess 4 is shaped so as to hold a respective cellular insert 2. To make it possible, the outer face of the cellular insert 2 is larger than the inner face of the cellular insert 2 and the mouth of the recess 4 is stricter than the bottom of the recess 4. Moreover, the shape of the recess 4 is substantially complementary to the shape of the corresponding cellular insert 2, as shown in FIGS. 1,2,3,4,6,7,8,9.

The outer face of each cellular insert 2 is covered by a cover layer 5, consequently the cover layer 5 remains between the foam liner 3 and the cellular insert 2 when the latter is arranged inside the recess 4 of the former, as shown in FIGS. 1,2,3,4,6,7,8,9.

The cover layer 5 of all embodiments can be made of an elastic material to follow the deformations of the cellular insert 2, in particular during an impact. Indeed, when an oblique impact occurs, the cellular insert 2 in-plane compresses, as shown in FIGS. 3,4,8,9 and the cover layer 5 follows the deformation of the cellular insert 2 without resistance. In this case, the elastic cover layer 5 can comprise small perforations to allow a transit of air through the cover layer 5. The small perforations can be small enough to hide the cellular insert 2 while permitting a permeability.

The cover layer 5 is attached to the outer face of the cellular insert 2.

Preferably, the cover layer 5 can be made of a woven or breathable fabric for allowing a transit of air through it. The cover layer made of fabric is indeed permeable to air even if the airflow that crosses the fabric is reduced with respect to the airflow that could transit through the cellular insert 2 without it.

Preferably the cover layer 5 is made of an elastic fabric to achieve a controlled permeability and to follow the deformations of the cellular insert 2.

Alternatively, the cover layer 5 can be a fabric sheet that is not elastic.

The cover layer 5 made of a fabric also can be waterproof and breathable. In this manner, in case of a rainy day, the helmet remains dry. An example of waterproof and breathable fabric can be Gore-Tex®.

By enlarging or restricting the mesh of the fabric, the permeability of the cover layer 5 made of a fabric can be increased or decreased.

Alternatively, the cover layer 5 can be not permeable to avoid a transit of air through it.

The cellular insert 2 comprises a cellular energy-absorbing material that performs better, in term of shock absorption, than traditional foam materials, in particular in terms of absorption of compressive impact energy.

The cellular insert 2 is made of a plurality of interconnected open cells 7. These cells 7 are configured to absorb energy by plastic deformation in response to a longitudinal compressive load, thus an out-of-plane compression.

Each cell 7 creates a tube having a sidewall and a longitudinal axis. Through each cell 7 an airflow can transit in a direction concurrent with the longitudinal axis.

The cells 7 are interconnected via their sidewalls 8. A bonding agent can keep the cells 7 joined together. The cells 7 can be welded to each other via a partial melting of their sidewalls 8. Alternatively, the cells 7 can be bonded by means of adhesive layers (not shown) interposed between adjacent sidewalls 8.

Figure 11:
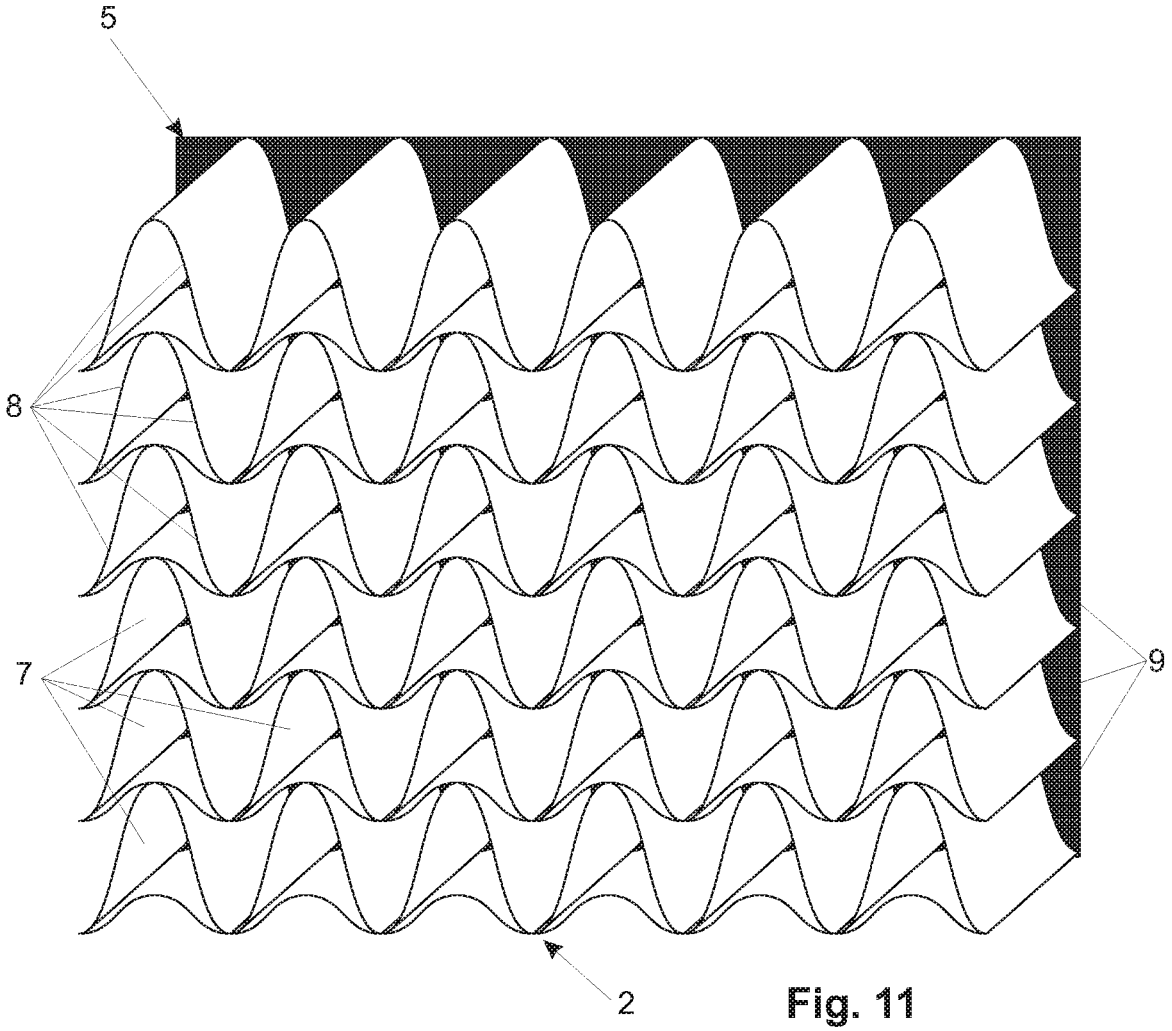
FIG. 11 shows an isometric view of a first type of cellular energy-absorbing insert with a cover layer.
Figure 12:
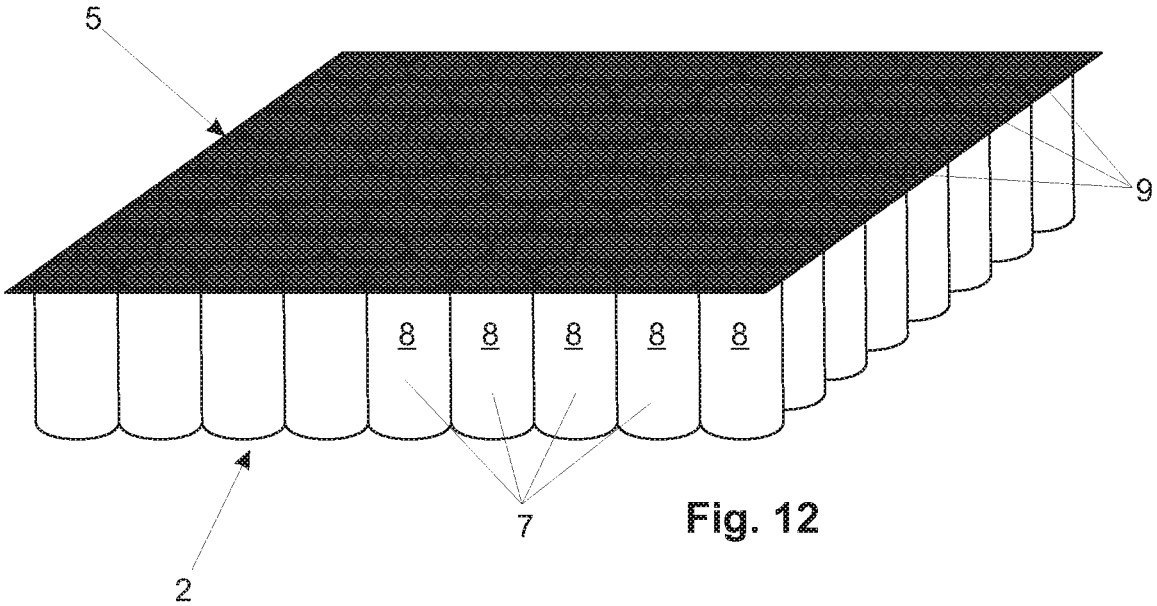
FIG. 12 shows an isometric view of a second type of cellular energy-absorbing insert with a cover layer.

The cellular insert 2 can be realized from a flat sheet of interconnected cells 7 that subsequently is curved. The flat sheet of cells 7, as shown in FIGS. 11,12, is like a tile or brick of interconnected cells 7 having parallel longitudinal axes. For obtaining the shape of the cellular insert 2, the flat sheet is firstly cut according to a specific shape and secondly is curved. The flat sheet has normally a constant thickness.

The flat sheet of cells 7 can be curved via thermoforming or manually if it has synclastic properties. The flat sheet of cells 7 of FIGS. 11,12 can thus assume a single-curved shape or a double-curved shape.

The cells 7 can be cylindrical tubes, as in FIG. 12. The tubes depicted in FIG. 12 have a circular cross-section. Alternatively, cells 7 can comprise sidewalls 8 bonded together to form tubes having other shapes. In particular, the cross-section of the cells or tubes 7 can be a square, a hexagon, a non-uniform hexagon, a re-entrant hexagon, a chiral truss, a diamond, a triangle.

In the example of FIG. 11, the cell 7 has an arrowhead shape. This kind of shape of cells 7 exhibits synclastic properties. Therefore, the sheet of cells 7 can be spherically curved without thermoforming.

The thickness of the sheet from which the cellular insert 2 is obtained can be between 15 and 40 mm.

When the cells 7 have a circular cross-section, the outer diameter of the circular cross-section can range between 2.5 and 8 mm, and the wall thickness of said cells 7 can range between 0.05 and 0.3 mm. According to these dimensional values, the energy absorption and the weight of cellular insert 2 is optimized.

The cover layer 5 is attached to the top edges 9 of the open cells 7 of the cellular insert 2.

The cover layer 5 can be attached to these edges 9 via a heat-activated adhesive. The heat-activated adhesive can be a thermoset polyester web film adhesive.

The main advantage of the cover layer 5 is that of improving the sliding of the cellular insert 2 in the recess 4 of the foam liner 3. In particular, the cover layer 5 avoid stops of the cellular insert 2 in the vent or vents 6 during an oblique impact. The cover layer 5 has the additional effect of spreading the energy of an impact over a greater number of cells 7, even if the load is applied punctually.

FIGS. 11,12 show two types of cellular insert 2 wherein the cover layer 5 is attached to the cellular insert 2. In FIG. 11, the cellular insert 2 is observed from its bottom and the cover layer 5 lies behind it. The top edges 9 of the cells 7 are attached to the cover layer 5. In FIG. 12, the cellular insert 2 is observed from a side, therefore the top surface of the cover layer 5 is visible.

In FIGS. 11,12 the cover layer 5 is a fabric having a dense texture that gives a glimpse of the cellular insert 2. The density of the texture can be thicker for covering completely the cellular insert 2. In this manner, the cover layer 5 is opaque and the cellular insert 2 cannot be see through the cover layer 5. Observing the helmet 1 from outside, the cellular insert 2 is thus not visible through the vents 6.

In this case, the cover layer 5 is slightly permeable and it can be employed in ski helmets, which require less permeability.

The cover layer 5 can also be colored or graphically customized for providing personalized visual effects.

Figure 2:
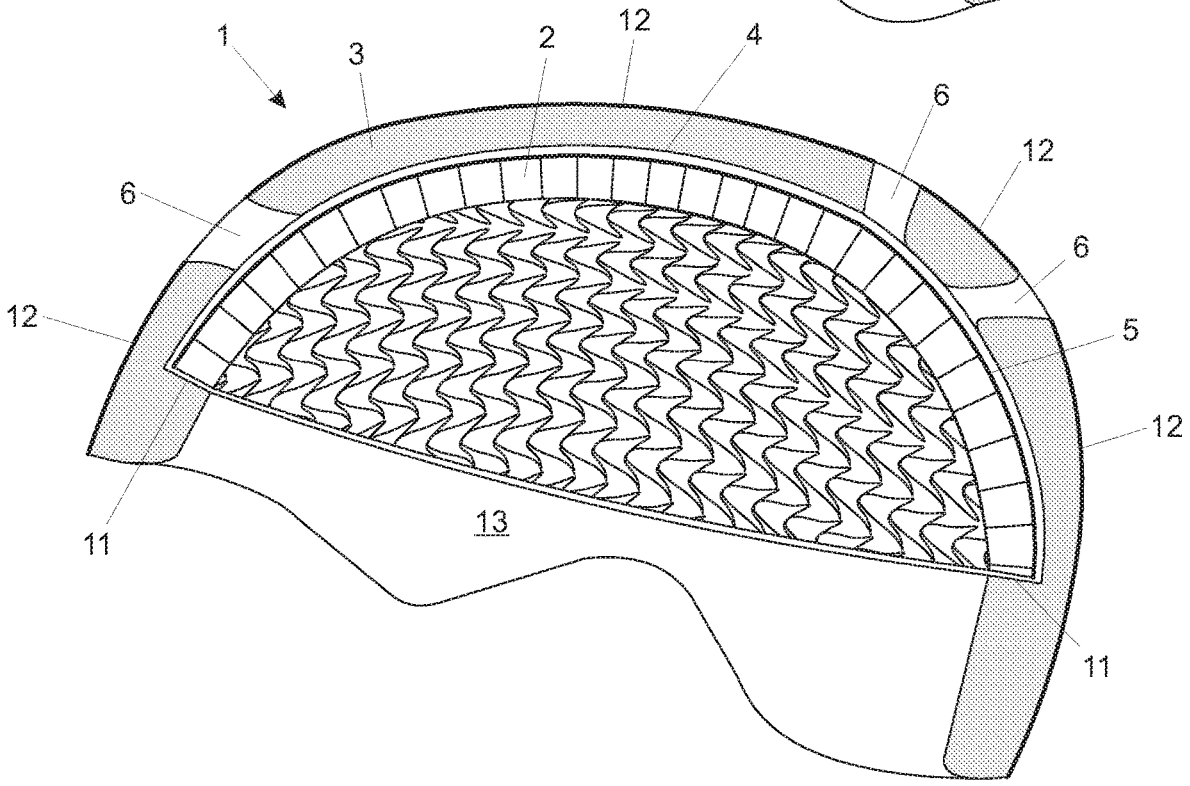
FIG. 2 shows a schematic cross-sectional view of a helmet according to a second embodiment of the present invention.
Figure 8:
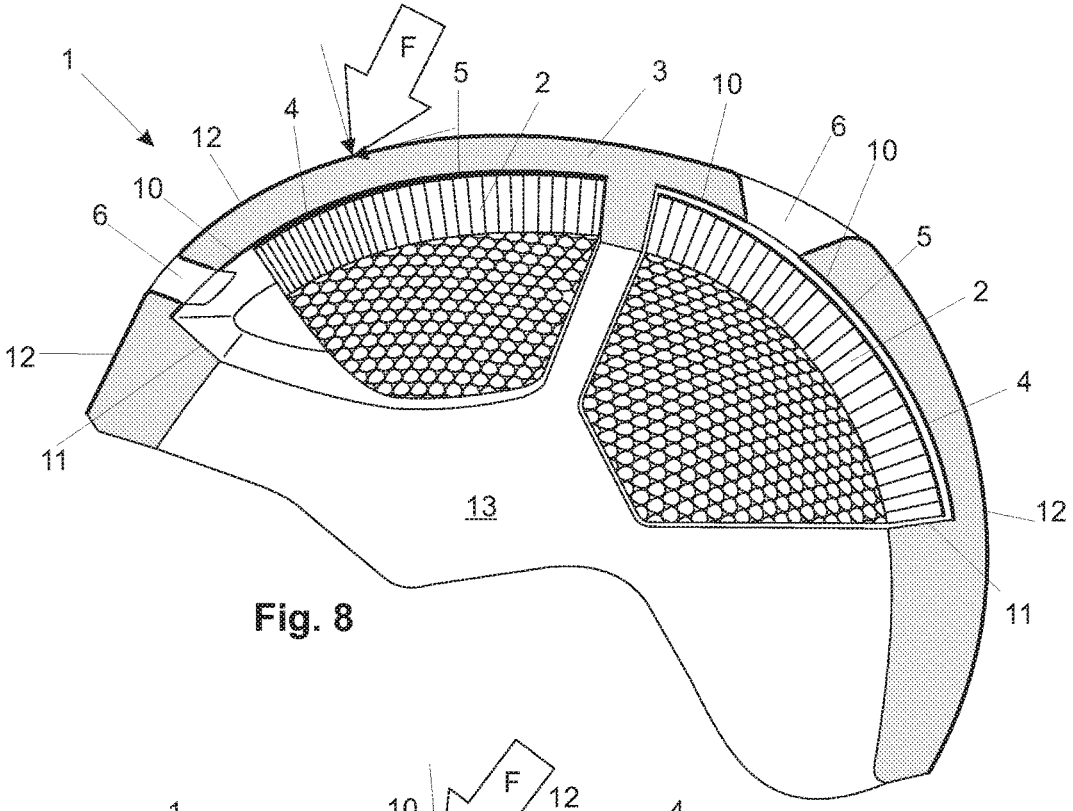
FIG. 8 shows the helmet of FIG. 6 during an oblique impact.
Figure 9:
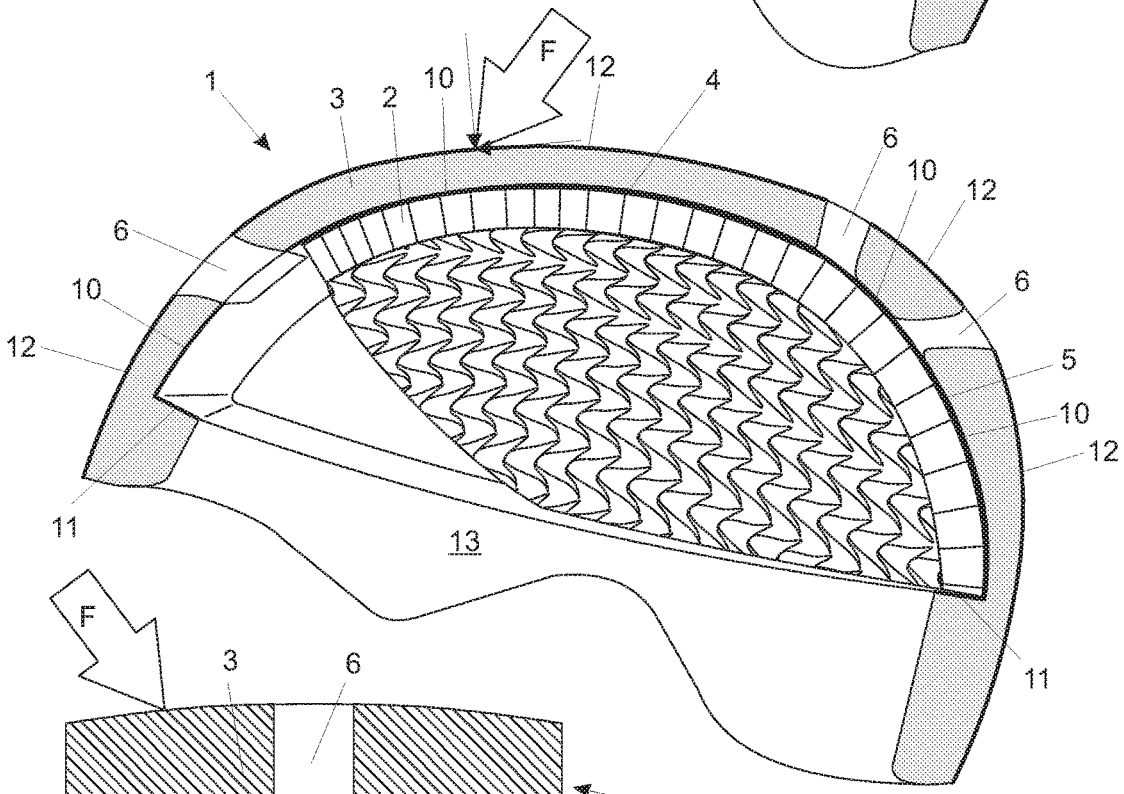
FIG. 9 shows the helmet of FIG. 7 during an oblique impact.

When the helmet 1 comprises an outer shell 12, the outer shell 12 and the cover layer 5 can have the same color or graphic, so that from outside the helmet 1 seems to have no The third and fourth embodiments of FIGS. 8 and 9 differ from the first and second embodiments of FIGS. 1 and 2 for the presence of a protective layer 10.

The protective layer 10 can be a film attached, or otherwise layered, to the bottom of the recesses 4, as schematically depicted in FIG. 8. Alternatively, the protective layer 10 can be a coating sprayed, or otherwise distributed, over the inner surface of the recess 4, as schematically depicted in FIG. 9. In the latter case, the protective layer 10 covers both the bottom and the sidewalls 11 of the recess 4.

All other features of first and second embodiments respectively coincide to those of third and fourth embodiments.

Figure 3:
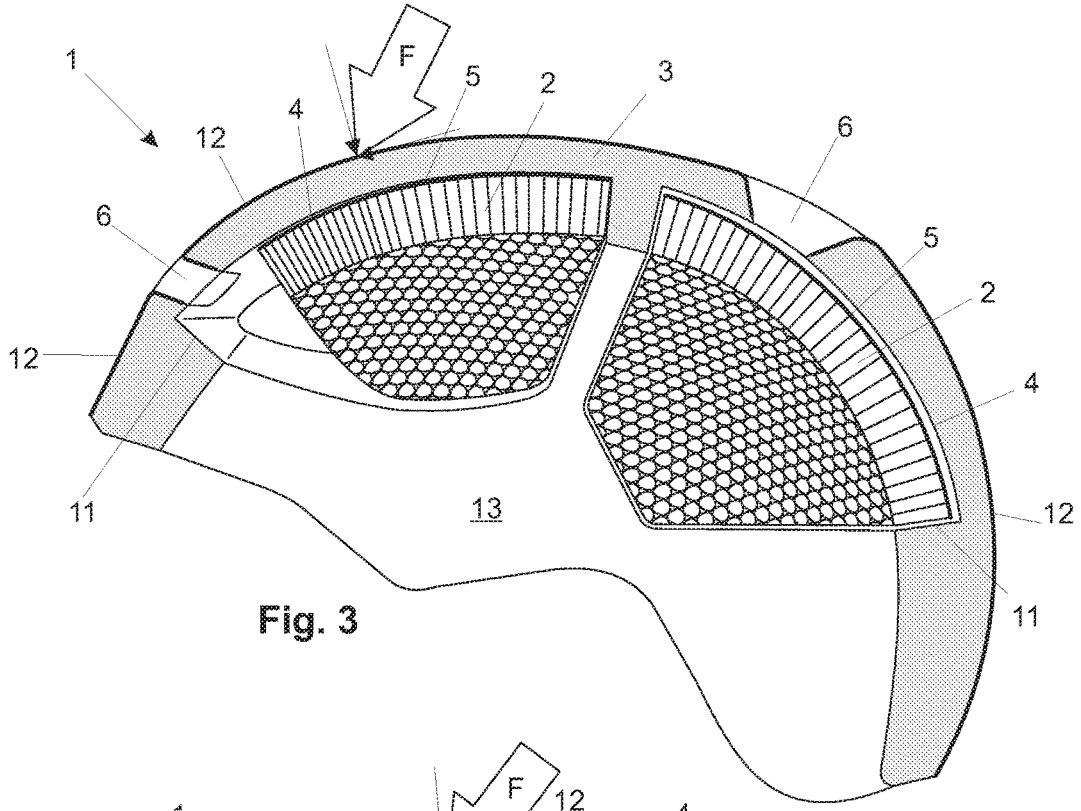
FIG. 3 shows the helmet of FIG. 1 during an oblique impact.
Figure 4:
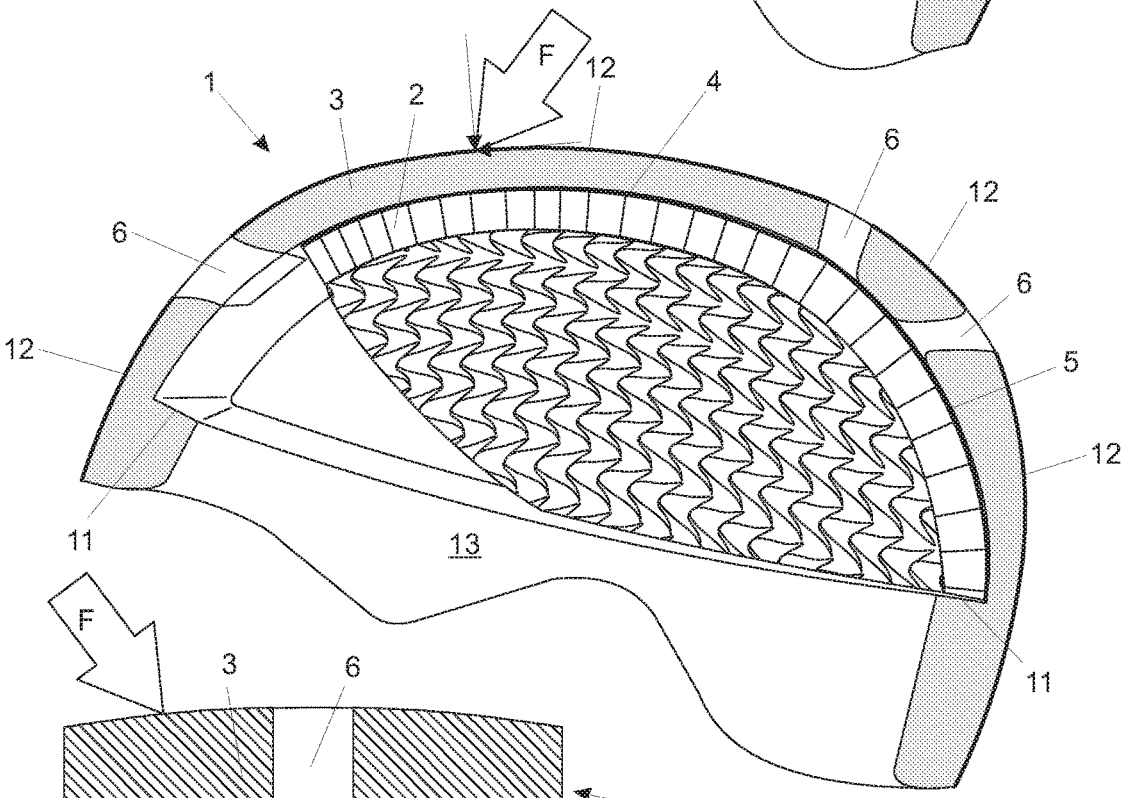
FIG. 4 shows the helmet of FIG. 2 during an oblique impact.

FIGS. 3,4 show the helmets of first and second embodiments when an oblique impact occurs. The term "oblique impact" means an impact comprising both a normal component and a tangential component, as shown in FIGS. 3,4,8,9. Terms "normal" and "tangential" make reference to the outer surface of the helmet 1.

The outer surface of the helmet 1 can be covered with an outer shell 12 as shown in FIGS. 1,2,3,4,6,7,8,9. Alternatively, the outer surface of the helmet 1 is devoid of an outer shell 12. The outer shell 12 can also be rigid or soft depending on the final destination of the helmet 1.

When the helmet 1 impacts an object, the helmet 1 is subject to a load, schematically depicted with an arrow and the reference sign "F" in FIGS. 3,4,8,9. The load F tends to rotate the helmet 1 and with it the head of the wearer, that is attached to the helmet 1 through a retaining system (not shown). Despite this, thanks to the cover layer 5, the cellular insert 2 can slide over the foam liner 3, or over the protective layer 10 attached to the foam liner 3. Therefore, a part of the helmet 1 rotates under the load F, while the cellular insert 2 in-plane compresses absorbing the tangential component of the load F and transferring less impact energy to the wearer's head. During this in-plane compression, the cover layer 5 follows the deformation of the cellular insert 2 because it is attached to the cells 7 of the cellular insert 2.

If the cover layer 5 is elastic or an elastic fabric, no wrinkles occur over the in-plane compressed cellular insert 2.

Figure 5:
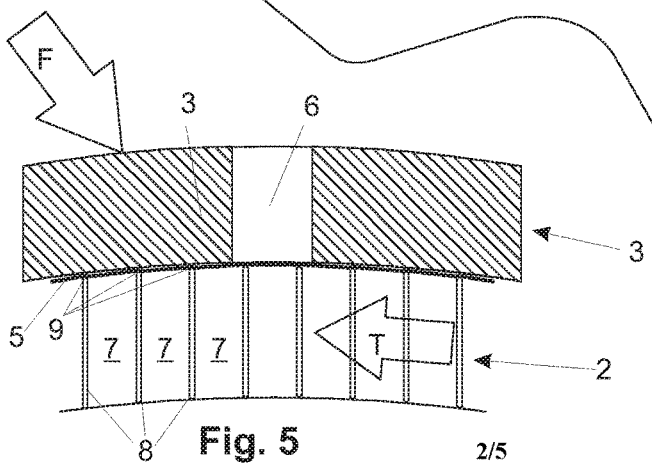
FIG. 5 shows a partial schematic cross-sectional view of the interaction between foam liner and cellular energy-absorbing insert of the helmets of first and second embodiments during an impact.
Figure 6:
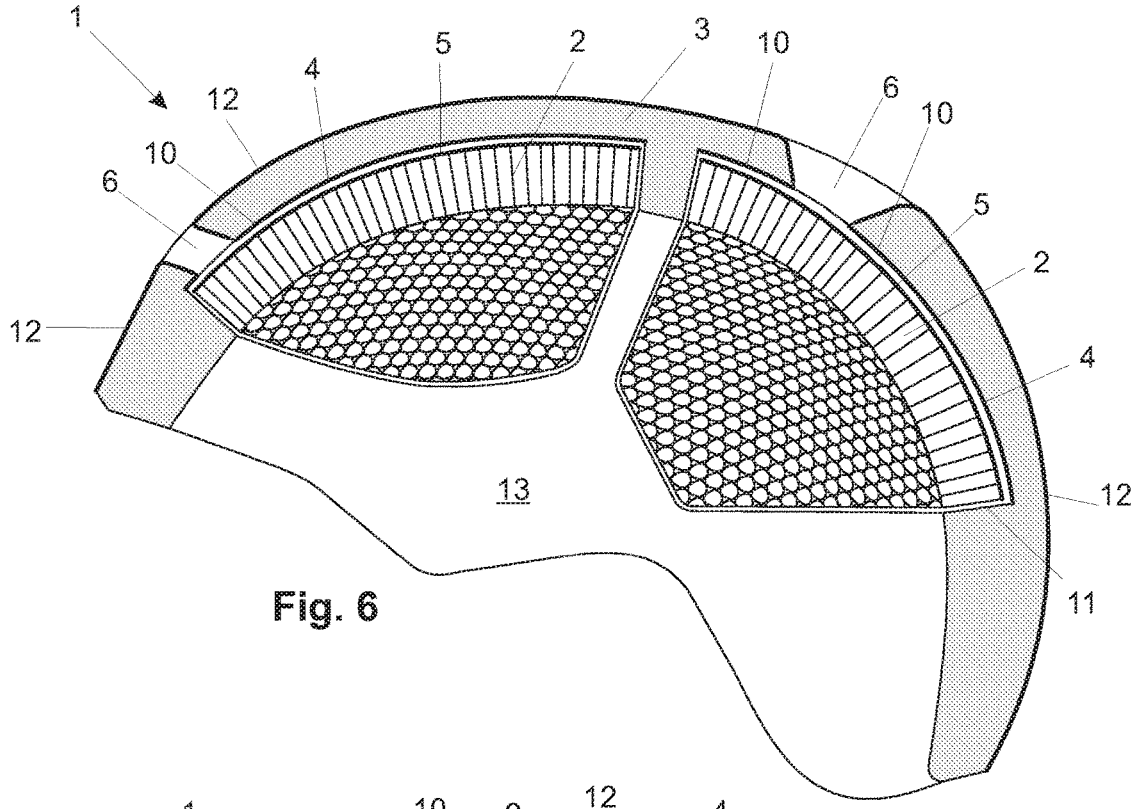
FIG. 6 shows a schematic cross-sectional view of a helmet according to a third embodiment of the present invention.
Figure 7:
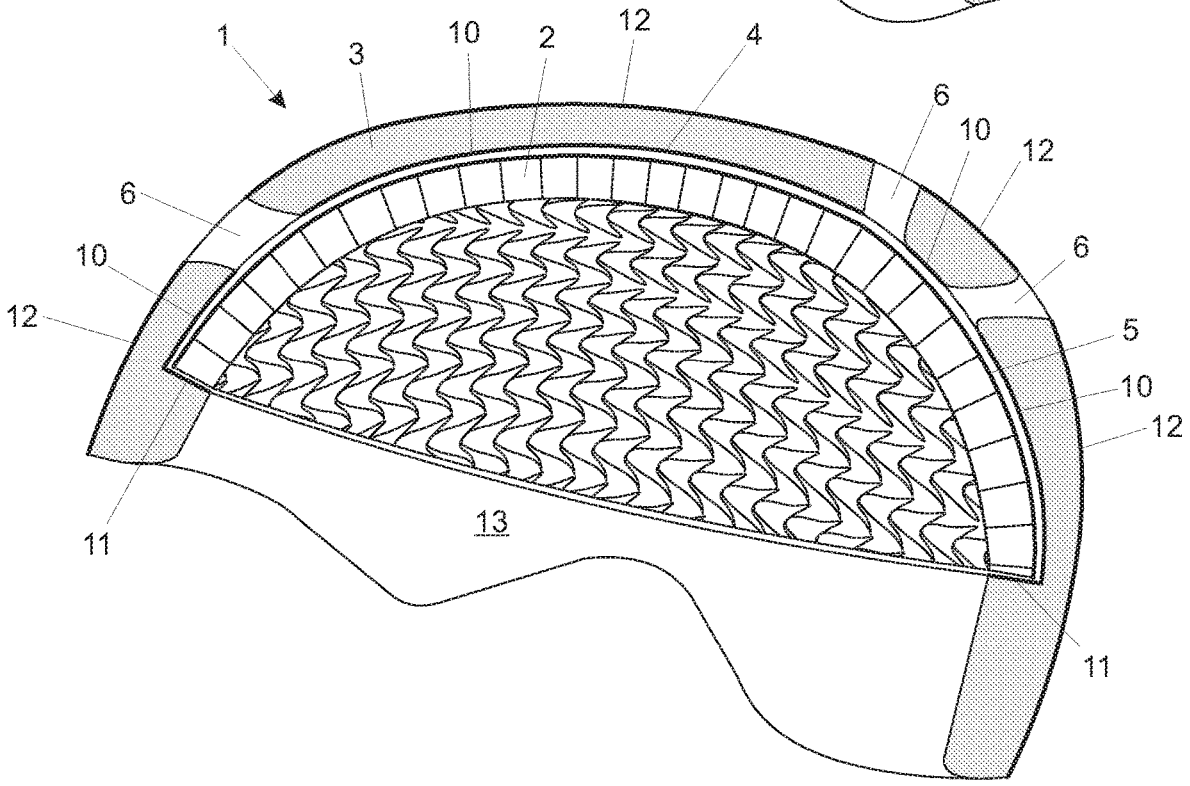
FIG. 7 shows a schematic cross-sectional view of a helmet according to a fourth embodiment of the present invention.
Figure 10:
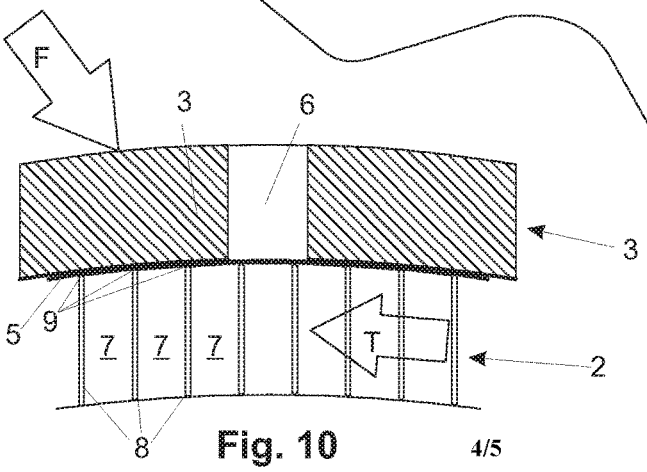
FIG. 10 shows a partial schematic cross-sectional view of the interaction between foam liner and cellular energy-absorbing insert of the helmets of third and fourth embodiments during an impact.

As shown in FIGS. 5 and 10, that are equal except for the presence of a protective layer 10 in FIG. 10, the cellular insert 2 with its cover layer 5 move relative the foam liner 3. In particular, thanks to the cover layer 5, the cellular insert 2 slides over the foam liner 3, or over the protective layer 10 attached to the foam liner 3, without entering or jamming in the vent 6.

The helmets of all embodiments of the present invention comprise vents 6 in the foam liner 3. If an outer shell 12 is present, the vent 6 also crosses the outer shell 12.

The vents 6 can lie in correspondence of the recess or recesses, 4 or not. If some vents 6 lie in correspondence of the vents 6, the cover layer 5 can be permeable or not depending on the final destination of the helmet 1. For example, if the helmet 1 is a ski helmet, a low permeability of the cover layer 5 is preferred.

The helmet 1 can also comprise vents lying outside the perimeter of the recess or recesses, 4 (not shown). In this case, these vents 6 run from the outer to the inner surfaces of the helmet 1.

Once that a small or a big amount of air crosses the cover layer 5, the air is free to flow through the cells 7 of the cellular insert 3 up to the cavity 13 wherein the head is arranged.

Concluding, the invention so conceived is susceptible to many modifications and variations all of which fall within the scope of the inventive concept, furthermore all features can be substituted to technically equivalent alternatives. Practically, the quantities can be varied depending on the specific technical requirements. Finally, all features of previously described embodiments can be combined in any way, so as to obtain other embodiments that are not herein described for reasons of practicality and clarity.

LEGEND OF REFERENCE SIGNS

1 helmet
2 cellular energy-absorbing insert
3 foam liner
4 recess
5 cover layer
6 vent
7 cell
8 sidewall (of cell)
9 edge (of cell)
10 protective layer
11 sidewall (of recess)
12 outer shell
13 cavity (for wearer's head)

The invention claimed is:

1. A helmet comprising:

at least a cellular energy-absorbing insert;

a foam liner comprising at least one recess shaped to accommodate the at least one cellular energy-absorbing insert;

a cover layer arranged between the foam liner and the at least one cellular energy-absorbing insert;

wherein the cover layer is attached to the at least one cellular energy-absorbing insert so that the cellular energy-absorbing insert slides together with the cover layer over the foam liner in response to an oblique impact.

2. The helmet according to claim 1, wherein the cover layer is made of an elastic material.

3. The helmet according to claim 1, wherein the cover layer is made of a fabric.

4. The helmet according to claim 1, wherein the cover layer is permeable to air.

5. The helmet according to claim 1, wherein the cover layer is opaque.

6. The helmet according to claim 1, comprising an outer shell, wherein the cover layer and an outer shell have the same color.

7. The helmet according to claim 1, wherein the cellular energy-absorbing insert comprises a plurality of interconnected open cells configured to absorb energy by plastic deformation in response to a longitudinal compressive load applied to said cells.

8. The helmet according to claim 7, wherein each cell comprises a tube having a sidewall and a longitudinal axis, and the cells are connected to each other through their sidewalls.

9. The helmet according to claim 7, wherein the cover layer is attached to open ends of said open cells.

10. The helmet according to claim 1, further comprising a protective layer attached to the foam liner in correspondence of the bottom of said recess.

11. The helmet according to claim 10, wherein the protective layer is also attached to the sidewall of said recess.

12. The helmet according to claim 10, wherein protective layer is a coating or a film layered over the recess of the foam liner.

13. The helmet according to claim 1, wherein cellular energy-absorbing insert has synclastic properties.

14. The helmet according to claim 1, wherein the cellular energy-absorbing insert is configured to provide greater impact-energy absorption than the foam liner.

15. The helmet according to claim 1, wherein the foam liner comprises vents through which an airflow can transit.

* * * * *